US008113911B1

(12) United States Patent
Hansen et al.

(10) Patent No.: US 8,113,911 B1
(45) Date of Patent: Feb. 14, 2012

(54) MATERNITY BODY SUPPORT

(75) Inventors: Kevin Hansen, Bellevue, WA (US); Jessica St Marie, Kirkland, WA (US)

(73) Assignee: Expecting Support, North Bend, WA (US)

( * ) Notice: Subject to any disclaimer, the term of this patent is extended or adjusted under 35 U.S.C. 154(b) by 201 days.

(21) Appl. No.: 12/614,753

(22) Filed: Nov. 9, 2009

Related U.S. Application Data

(60) Provisional application No. 61/198,692, filed on Nov. 7, 2008.

(51) Int. Cl.
*A41C 3/00* (2006.01)

(52) U.S. Cl. ..... 450/155; 450/86; 450/14

(58) Field of Classification Search ..... 450/1, 155, 450/30–33, 7–11, 86, 14–18; 602/19, 2, 602/60, 61, 67, 70; 128/99.1, 100.1, 96.1, 128/101.1, 106.1, 107.1, 109.1, 869, 870, 128/873–876
See application file for complete search history.

(56) References Cited

U.S. PATENT DOCUMENTS

| | | | | | |
|---|---|---|---|---|---|
| 251,431 | A | * | 12/1881 | Glinning | 450/107 |
| 284,831 | A | * | 9/1883 | Galny | 450/113 |
| 2,743,449 | A | * | 5/1956 | Sheldon | 450/113 |
| 3,282,264 | A | | 11/1966 | Connelly | |
| 4,005,715 | A | | 2/1977 | Moore | |
| 4,746,318 | A | * | 5/1988 | Moyer | 450/155 |
| 4,789,372 | A | * | 12/1988 | Wicks | 450/155 |
| 4,822,317 | A | * | 4/1989 | Wimmer | 450/14 |
| 4,836,824 | A | * | 6/1989 | Seering et al. | 450/155 |
| D313,290 | S | | 12/1990 | Seering | |
| 5,094,648 | A | | 3/1992 | Turner | |
| 5,702,286 | A | * | 12/1997 | Seering et al. | 450/155 |
| 5,928,059 | A | * | 7/1999 | Wicks | 450/155 |
| 6,846,220 | B2 | * | 1/2005 | Wakefield | 450/155 |
| 7,008,292 | B2 | * | 3/2006 | Cosentino et al. | 450/155 |

FOREIGN PATENT DOCUMENTS

WO PCT/2006/000609 2/2007

* cited by examiner

*Primary Examiner* — Gloria Hale
(74) *Attorney, Agent, or Firm* — Dean A. Craine

(57) ABSTRACT

A maternity body support worn for correcting a woman's posture that includes an expandable body shell with a lower torso section, an upper torso section, a back section, and an abdominal opening. Mounted on the body shell is a pair of lower anchors located on opposite sides of the body, a pair of upper anchors located near the upper lateral region of the chest, a pair of elastic first support straps, and a pair of elastic second support straps. The first support straps attach to the lower anchors and then extend upward and around the back and coupled to the opposite shoulder complexes. The second support straps extend between the lower and upper anchors on each side of the body. The body shell, the two pairs of anchors and the two pairs of straps support the body and simultaneously rotate the opposite pelvis backwards and move the opposite shoulder complexes towards the mid-line.

20 Claims, 12 Drawing Sheets

MATERNITY BODY SUPPORT

This utility patent application is based on and claims the priority filing date of the provisional patent application (Ser. No. 61/198,692) filed on Nov. 7, 2008.

COPYRIGHT NOTICE

Notice is hereby given that the following patent document contains original material which is subject to copyright protection. The copyright owner has no objection to the facsimile or digital download reproduction of all or part of the patent document, but otherwise reserves all copyrights whatsoever.

BACKGROUND OF THE INVENTION

1. Field of the Invention

This invention relates generally to garments designed to support the abdomen of a pregnant woman and, more particularly to garments designed to support the woman's spine and pelvis.

2. Description of the Related Art

The posterior pelvic joints, also called the sacro-iliac joints, are functional joint complexes that connect the two pelvic bones (innominates) to the wedge-shaped tailbone (sacrum). The movement of the pelvic bones within this functional joint complexes occurs in three planes of motion. The movement within these three planes is referred to as the anterior and posterior rotatory movements of the innominates. Posterior rotatory movements of the pelvic bones increase the stability of the sacro-iliac joints. Conversely, anterior rotatory movements of the pelvic bones reduce the stability of the sacro-iliac joints.

Like the movement of the pelvic bones, the shoulder complex (scapular-humeral complex) is another functional joint complex that involves movement in several planes of motion. The structures in the shoulder involve the clavicle, the scapula, the upper spinal vertebrae, and the upper end of the humerous.

Humans should move in a reciprocal (contra-lateral) manner when walking which means that the left upper limb and right lower limb function as a unit and the right upper limb and left lower limb function as a unit during upright movement activities. Ideally, when walking, the right arm and left leg should swing forward at the same time as does the opposing left arm and right leg, respectively. By using a side-to-side counter-balance between the upper and lower limbs, increase stability is achieved during upright movement activities.

When walking, the moment of highest challenge on these functional units occurs just after the heel of the leading foot strikes the ground and body's weight begins to project over the foot. At this moment, the pelvic bone experiences its greatest stability challenge as the upward projecting force coming through the lower limb is met by the opposing downward projecting force created by the weight of the forward leaning upper body. At the same time, the opposing shoulder complex is at its moment of highest strain as the arm and shoulder are projecting forward to counterbalance the forward step of the opposite lower limb. What is observed over the shoulder complex is a forward and inward movement of the arm, a forward and outward movement of the shoulder blade, and an increased reverse curve in the upper back.

In pregnancy, the additional weight of the fetus in front of the pelvis further challenges these functional units by moving the pelvic joints towards their less stable, anterior rotatory position as well as creating additional compensatory torsional movement through the opposing shoulder complex.

During pregnancy, the position and weight of the fetus and increase size of the uterus disrupts the desired, upright balance of the body. In response to growth of the fetus and uterus, the pelvic bones rotate forward in a three dimensional pattern and the amount of curvature to the spine increases. To maintain an upright balance, the body compensates by swaying the shoulder backwards. The consequence of this postural disruption is a progressive increase in the upper and lower curves of the spine. As a result, lower back and pelvic pain is a major source of discomfort in pregnancy.

The inventors believe that what is needed is a maternity body support that provides greater functional stabilization. In order to provide functional stability, the body support should apply forces to the pelvic bones and shoulder complexes which (a) directly reverse or oppose their direction of maternity induced stress in all planes of motion, and (b) provide direct vertical support. Also, the garment should apply forces to the shoulder complexes which reverse or oppose the compensatory movements. In other words, the directional force applied to the front side of the pelvic bones needs to be: (a) backward, upward and inward combined and (b) combined with a direct upward force. The directional forces applied to the shoulder complexes needs to be backward-outward on the arm and backward-upward to the shoulder blade, and a straightening of the spinal curve in the upper back.

Ideally, the support for each functional unit should be coupled to provide a counterbalance to the forces being exerted on the body. This means that the right pelvic bones and the left shoulder should be coupled together and the left pelvic bone and the right shoulder complex should be coupled together. By coupling the opposite functional units together, a greater amount of stabilization is provided when the body is at its greatest moment of strain, just after the heel of the leading foot strikes the ground and the body's weight begins to project over the foot.

SUMMARY OF THE INVENTION

These and other objects of the present invention are met by the maternity body support that includes a lightweight body shell with a lower torso section, an upper torso section, and a front abdominal opening. Mounted on the opposite sides of the body shell are two lower anchors and two upper anchors. The two lower anchors are located on opposite sides of the body shell slightly above and forward of the pelvic joints while the two upper anchors are located directly above the two lower anchors slightly forward and below the user's axillas. Extending between the upper and lower anchors on the same side of the body shell is an adjustable second support strap that couples the lower anchor and upper anchor together.

Attached to each lower anchor is a first support strap that extends upward around the user's back and towards the opposite shoulder. A means for coupling each first support strap to the shoulder complex is provided so that a rearward and downward direct force is created on the shoulder complex that resists forward and upward movement of the shoulder complex Each first support strap is adjustable in length to accommodate different size users and to accommodate anatomical changes to the user during pregnancy.

The body shell, the four anchors, the two first straps and two second straps function together to support and create opposing forces on both opposite shoulder complexes and pelvic joints thereby minimizing angular distortion which improves the user's dynamic posture and reduces excessive curves of the spine and pelvis.

DESCRIPTION OF THE PREFERRED EMBODIMENT(S)

Figure 1:
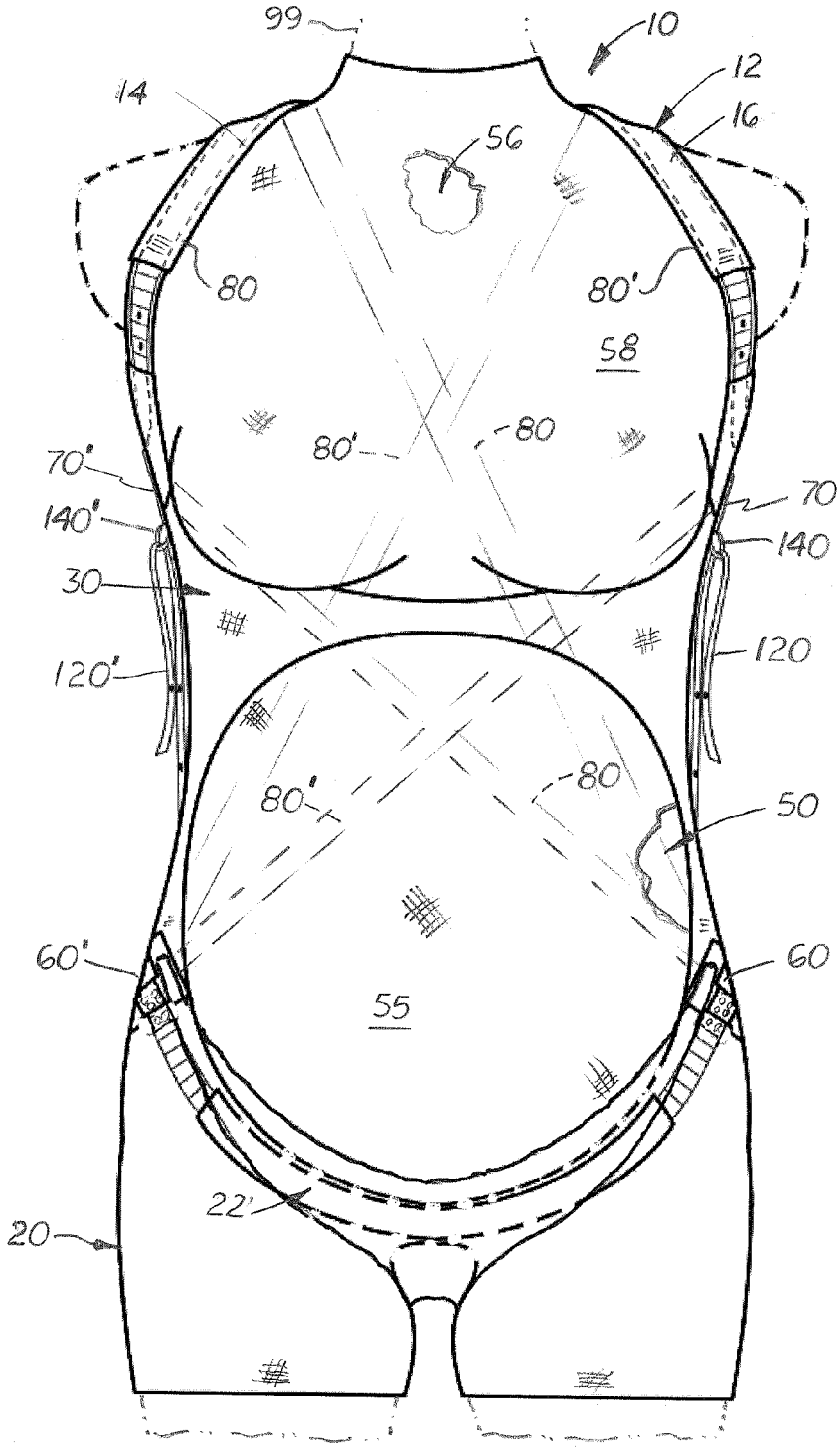
FIG. 1 is a front elevational view of a woman wearing the first embodiment of the maternity body support.
Figure 2:
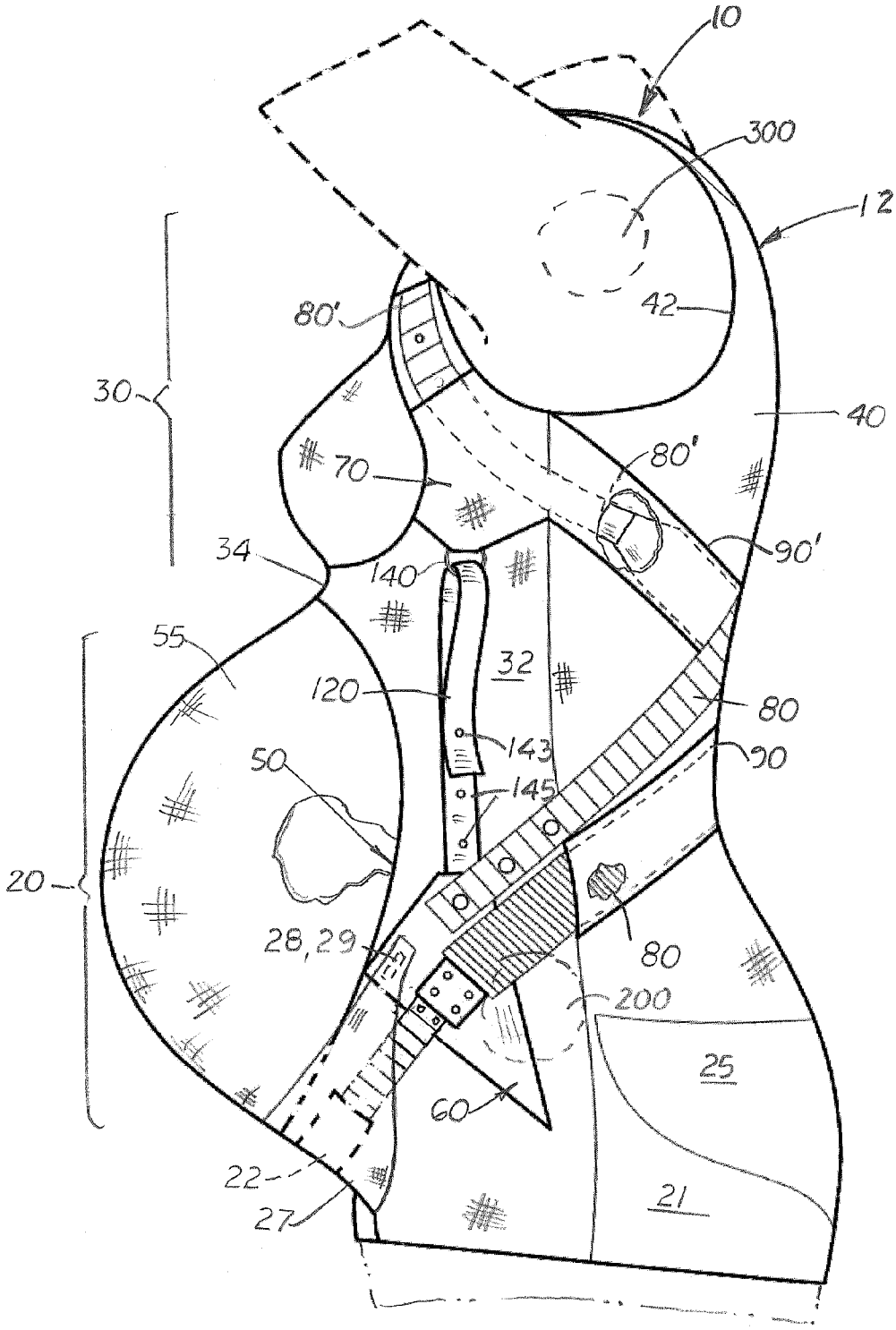
FIG. 2 is a left side elevation view of the woman wearing the maternity body support shown in FIG. 1.
Figure 3:
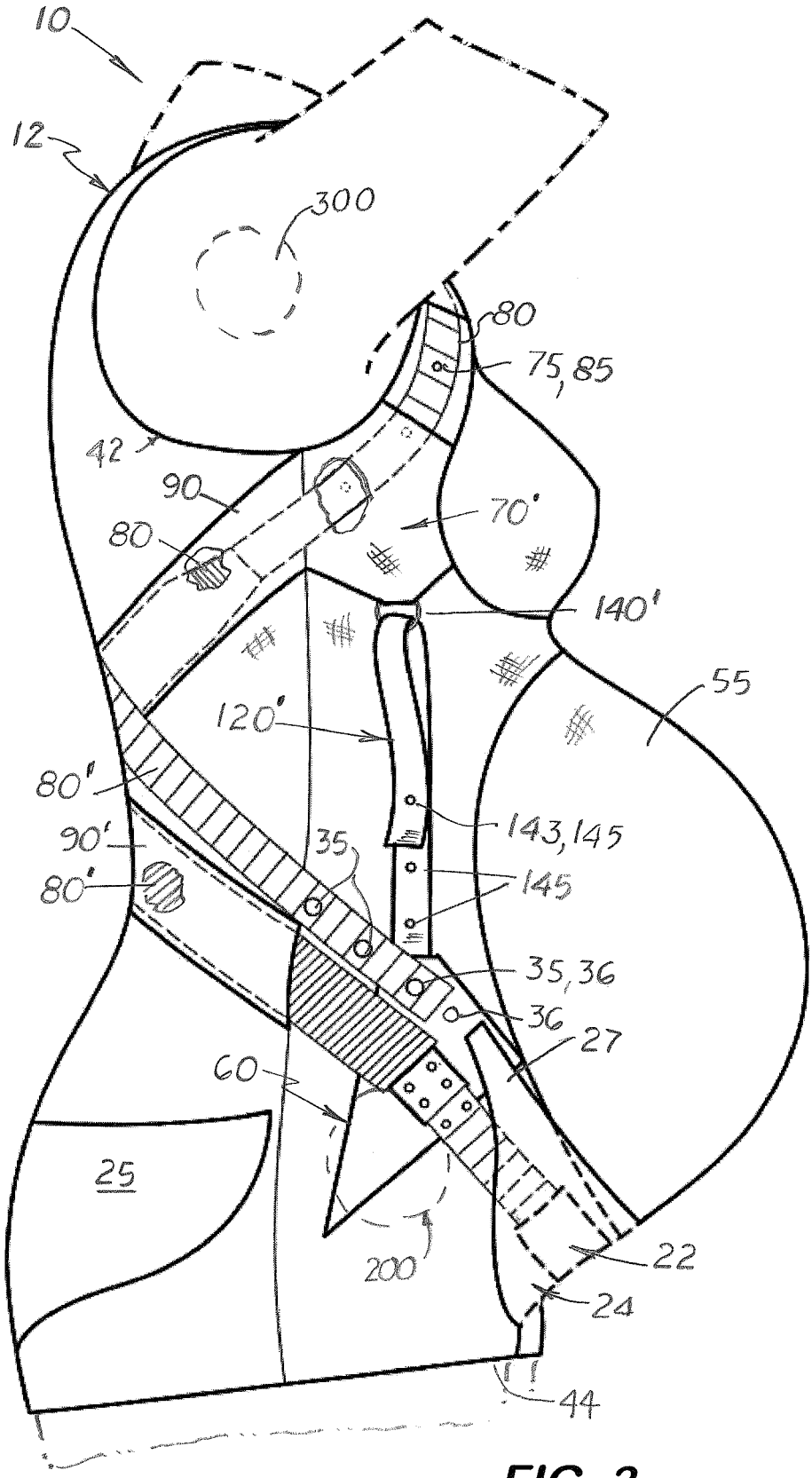
FIG. 3 is a right side elevation view of the woman wearing the maternity body support shown in FIG. 1.

Referring to the accompanying Figs. three embodiments of a maternity body support, generally indicated by the reference numbers 10, 10', and 10" designed to be worn by a women during pregnancy that provide greater support and functional stability to the pelvic joints 200 and the shoulder complexes 300. The body supports 10, 10', 10" are designed to apply forces to the user's pelvic bones directly reverse or oppose their natural direction of movement and to apply forces to the user's shoulder complexes that reverse or oppose their natural compensatory movements.

FIGS. 1-6 show the first embodiment of the body support 10 that includes a body shell 12, lower torso section 20, an abdominal strap 22, an upper torso section 30, a back section 40, an abdominal opening 50 and a pair of shoulder straps 14, 16. Securely mounted on the outer surface of the body shell 12 are a pair of lower anchors 60, 60' and a pair of upper anchors 70, 70'.

The lower torso section 20 includes a panty component 21 designed to cover the user's perineum, buttocks, the lower hip areas, and the top of each leg. The crotch area of the panty component 21 may be open or closed. Extending transversely over the front surface of the panty-component 21 is an elastic abdominal strap 22 designed to hold and support the user's abdomen when the body suit 10 is worn.

Figure 4:
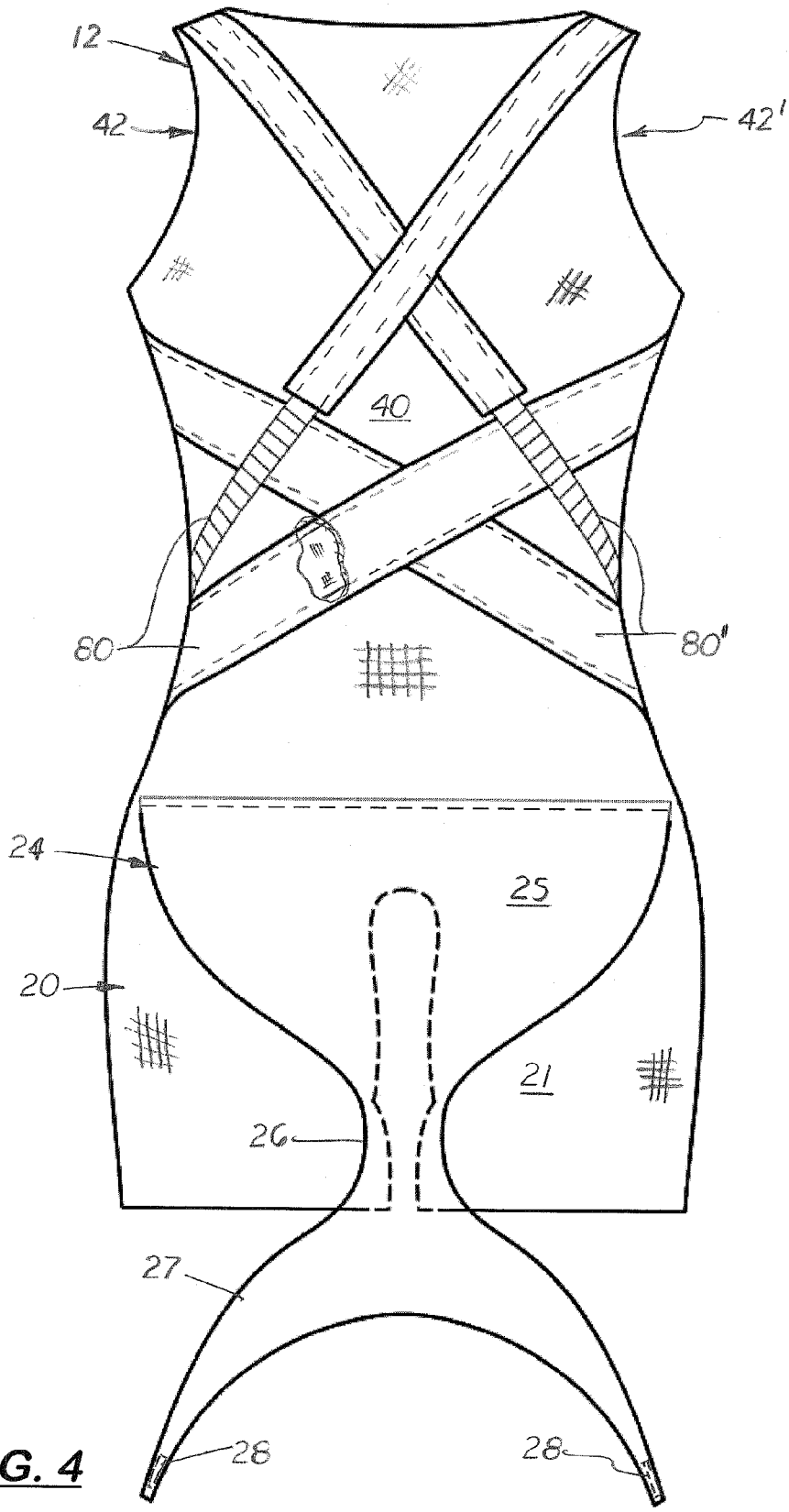
FIG. 4 is a rear elevational view of the woman wearing the maternity body support shown in FIGS. 1-3 showing a flap attached to the rear surface of the panty and shown in an unfolded position.
Figure 5:
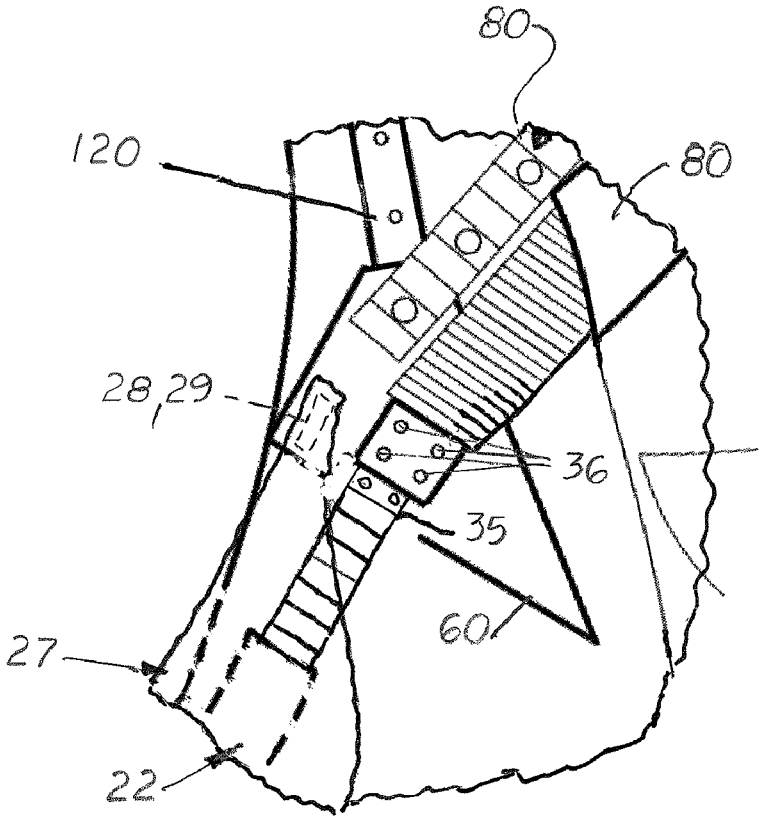
FIG. 5 is a partial plan view of the lower anchor showing the proximal and distal ends of two opposite first support straps and the lower end of a second support strap attached thereto.

Attached over the rear portion of the panty-component 21 is an hour glass-shaped flap 24. As shown in FIG. 4, the flap 24 includes a rear section 25 designed to cover the buttocks, a narrow middle section 26 designed for fit comfortably between the legs and cover the crotch, and a wide front section 27 designed to cover the lower abdomen when folded upward. Attached to the ends of the wide front section 27 are two hook or loop pad connectors 28, 28' that connect to two complimentary hook or loop pad connectors 29, 29', respectively, that selectively attach the wide front section 27 to the front surfaces of the lower anchors 60, 60', respectively.

When worn, the two pairs of pad connectors 28, 28', and 29, 29' hold the flap 24 under the crotch and can be easily disconnected as needed. It should be understood that hook and loop pad connectors 28, 28' and 29, 29' can be replaced by snaps, buttons or any other suitable temporary connecting structures. The body shell's upper torso section 30 includes two side panels 32, 32' integrally formed with the lower torso section 20 and the upper transverse panel 34 that extends over the upper front surface of the user's chest near the diaphragm. The upper torso section 30 also includes two shoulder straps 14, 16 that extend over the user's shoulders and connect to the back section 40. Formed between the upper transverse panel 34, the two side panels 32, 32' and the upper edge of the lower torso section 20 is an abdominal opening 50 designed to accommodate the user's expanding abdomen. An optional lightweight, expandable panel 55 is sewn to the outer edges of the abdominal opening 50 to cover the user's abdomen. The area on the upper torso section 30 adjacent to the breasts may be integrally formed with the upper torso section 30 or may include an opening 56 and covered by a lightweight, expandable panel 58.

The body shell's back section 40 covers the entire back from the user's waist to the base of the neck. Arm holes 42, 42' are formed on the upper portion of the back section 40 to allow the user's arms to extend through. It should be understood however, that a modified body shell 12 with a partially covering back section and with full or half-full sleeves may be used.

Mounted on the opposite sides of the body shell 12 are two lower anchors 60, 60' and two upper anchors 70, 70'. The two lower anchors 60, 60' are located on opposite sides of the body suit slightly above and forward of each pelvic joint. The two lower anchors 60, 60' are securely mounted to the body shell 12 and act as reinforced connection points for the ends of the transverse elastic strap 22 and the two arms on the flap 24, at least one end of the first support strap 80, 80' and at least one end of the second support strap 120, 120'. In the Figs., each lower anchor 60, 60' is depicted as a narrow triangular-shaped structure with an upper wide area and a narrow, lower tip that extends downward over the outside surface of the user's leg. It should be understood, however, that lower anchors 60, 60' are not limited to this size and shape.

Attached to the two lower anchors 60, 60' are two first support straps 80, 80'. Preferably, the first support straps 80, 80' are made of elastic material enabling them to strength 3 to 20% of their resting length. It should be understood, however, that for some uses, the first support straps 80, 80' may also be made of non-elastic material.

Securely attached to the two intersections between the upper torso section 30 and the back section 40 are two upper anchors 70, 70'. The two upper anchors 70, 70' are located directly above the lower anchors 60, 60' slightly forward and below the user's axilla. Extending through each anchor 70, 70' is a first support strap 80, 80', respectively.

Figure 6:
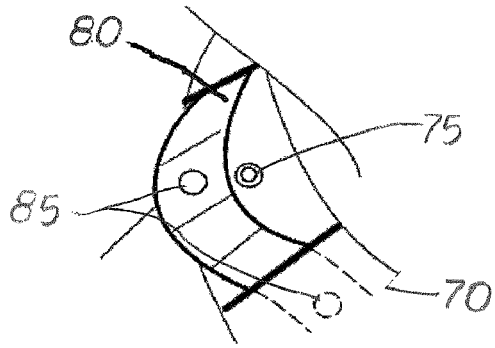
FIG. 6 is a partial plan view of the upper anchor showing the exposed, upper section including snaps and being adjusted in length.
Figure 7:
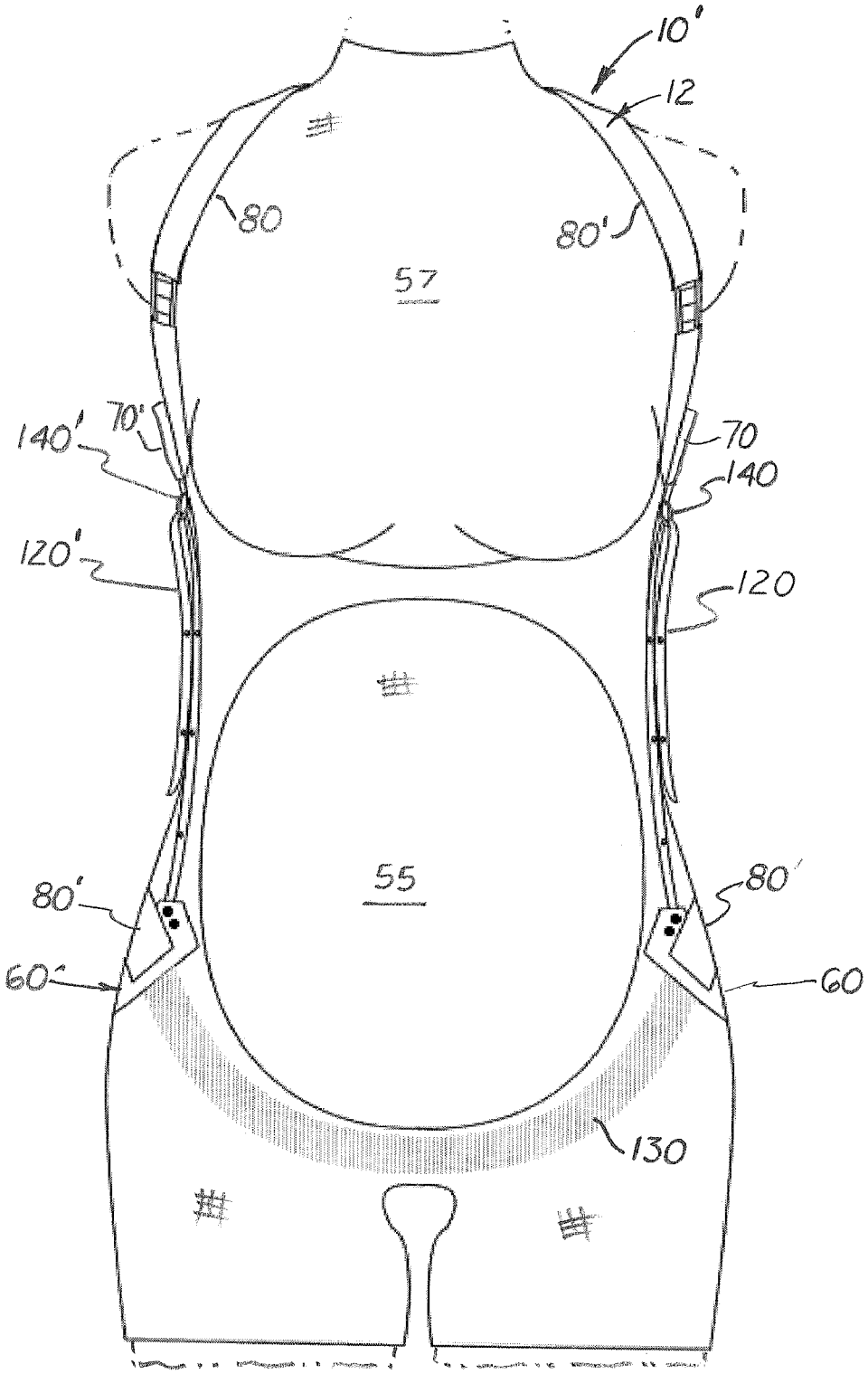
FIG. 7 is a front elevational view of a woman wearing the second embodiment of the maternity body support.
Figure 8:
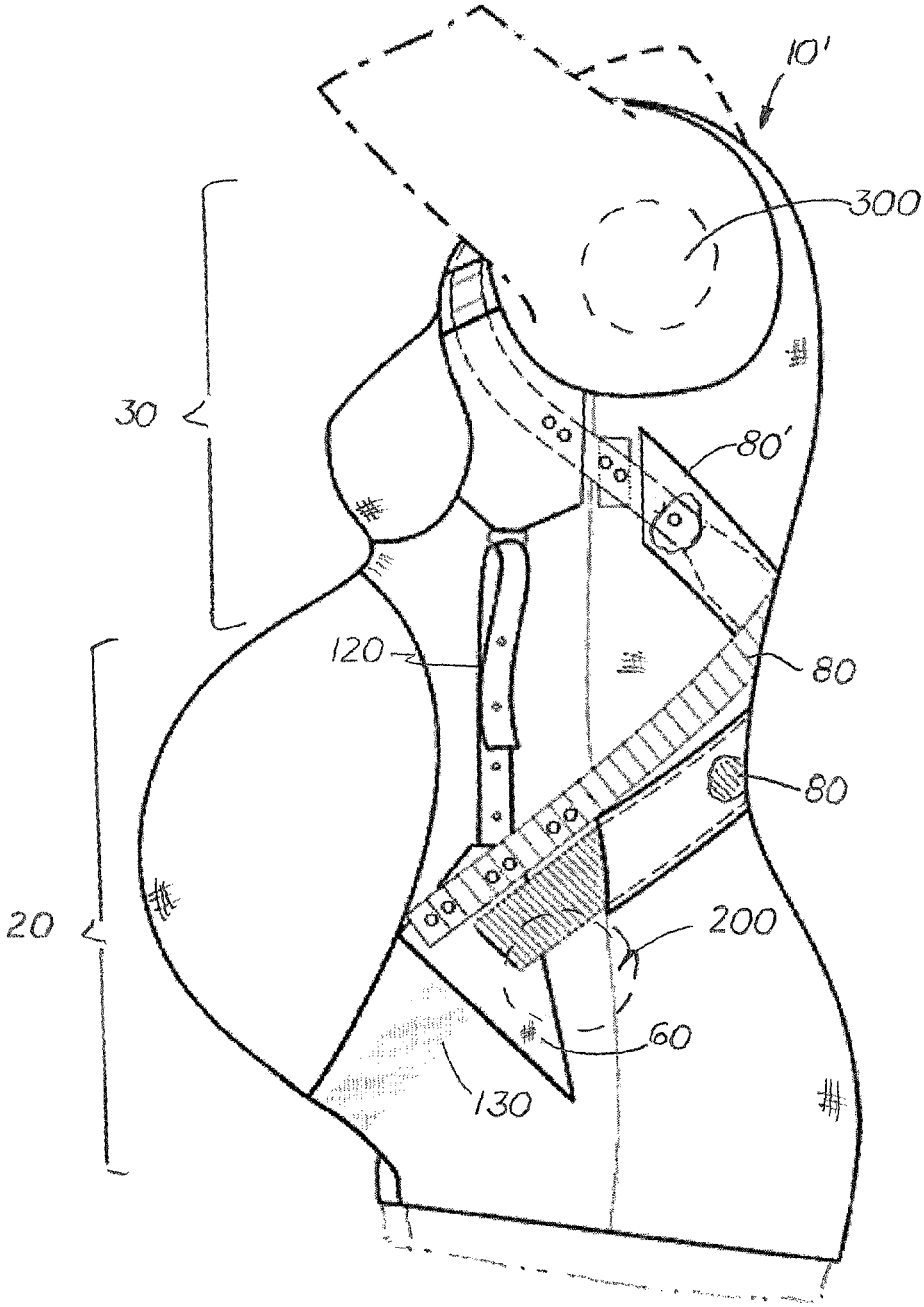
FIG. 8 is a left side elevation view of the woman wearing the maternity body support shown in FIG. 7.
Figure 9:
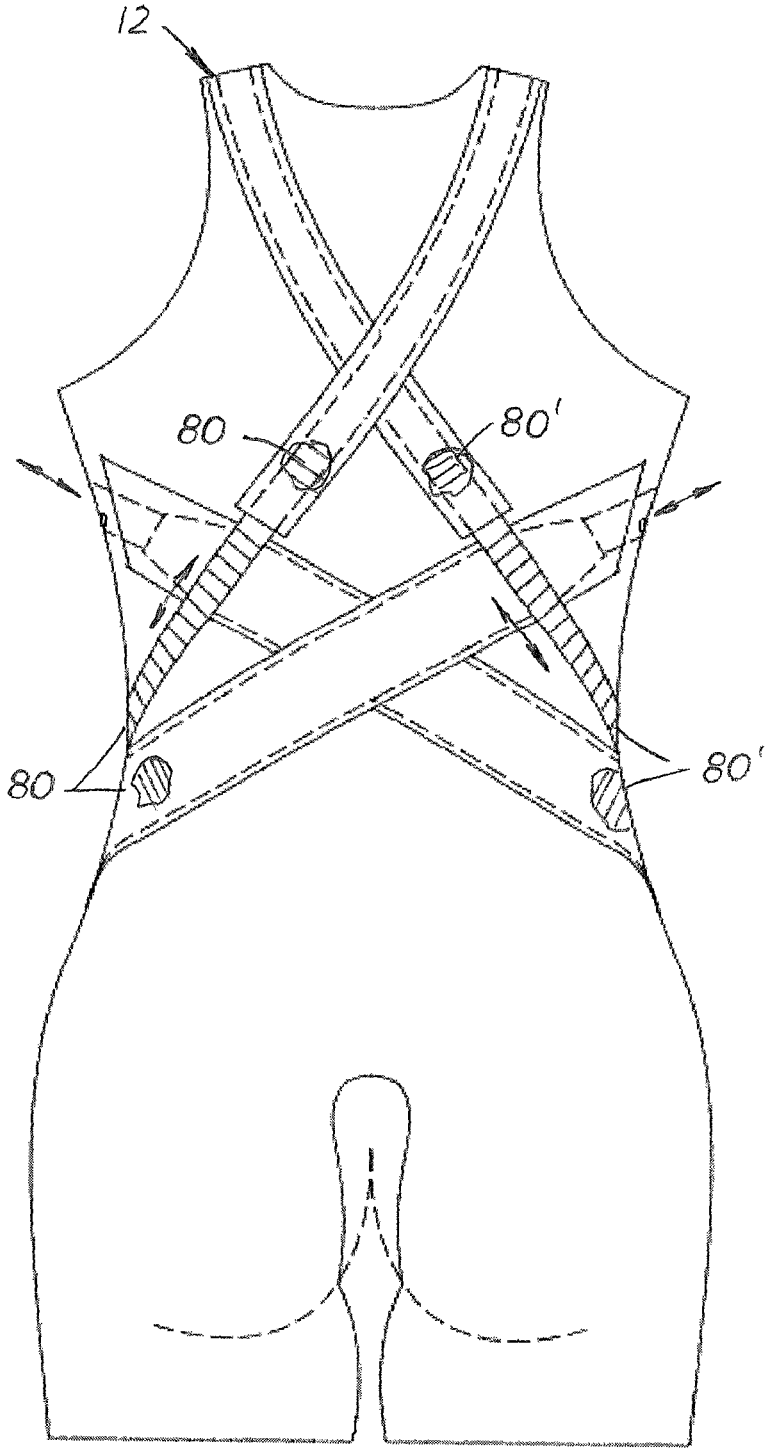
FIG. 9 is a rear elevational view of the woman wearing the maternity body support shown in FIGS. 7 and 8.

The first support straps 80, 80' extend diagonally upward and across the back section 40 and over or through the arm straps 14, 16. The first support straps 80, 80' then extend downward over the upper chest and around the shoulder complex 300 opposite the lower anchors 60, 60' to which the strap's proximal ends are attached. As shown in FIG. 6, the exposed middle section of the each first support straps 80, 80' include connecting means, such as snaps or hook or loop connectors or buttons that enable the middle section of the first support strap 80, 80' to be selectively attached to the body shell 12. During use, the user may finely adjust the tension on the upper and lower sections of each first support strap 80, 80' to provide greater or less support and comfort.

Formed on the middle area of the back section 40 and extending diagonally downward from the axilla area to the opposite hip are diagonally aligned optional tunnel 90, 90'. The tunnels 90, 90' terminate slightly above the lower anchors 60, 60', respectively. The distal ends of the first support strap 80, 80' extend from the tunnels 90, 90', respectively, and then selectively attach to the lower anchors 60, 60'.

The second pair of support straps 120, 120' connects at their lower ends to the top edge of the lower anchors 60, 60' and then extends vertically upward along the sides of body and connects the lower edges of the upper anchors 70, 70', respectively. The pair of support straps 120, 120' are shown affixed at one end to the lower anchors 60, 60', respectively. However, it should be understood that the second support straps 120, 120' may be selectively attached via snaps 143, 145, buttons, hook and loop connector pads, or any other suitable connectors attached to the adjoining surface.

The second support straps 120, 120' then extend upward from the adjacent lower anchors 60, 60', respectively, and extend through a D-ring 140, 140', respectively, or some other suitable structure attached to the upper anchors 70, 70', respectively. The second support straps 120, 120' are designed to be adjustable in length so snaps, buttons, buckles or hook and loop connectors on the surfaces of the structure that allow the lengths of the straps 120, 120' be adjusted.

As mentioned above, the first support straps 80, 80' are made of elastic material to allow the proximal ends of the first support straps 80, 80' to be selectively attached or permanently affixed to the lower anchors 60, 60', respectively.

The ends of the elastic strap 22 is adjustably connected to the outside surface of the lower anchors 60, 60' with snap cap 35 and post connectors 36 disposed between the inside surface of the elastic strap 22 and the outside surface of the lower anchors 60, 60'.

FIGS. 7-12 show a second embodiment of the body support 10', that is identical to the first embodiment of the body support 10 except for the panty component 21 the pad connectors 29, 29' on the lower anchors 60, 60', and the location of the snap connectors 75, 85 or hook and loop connectors used to connect the intermediate sections of the first support straps 80, 80' to the body shell 12.

Figure 10:
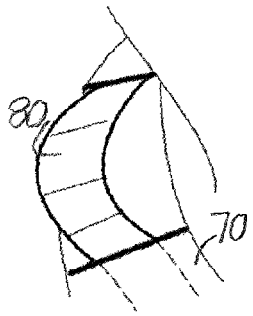
FIG. 10 is a partial plan view of the exposed upper section of the first support strap sliding into the upper anchor.
Figure 11:
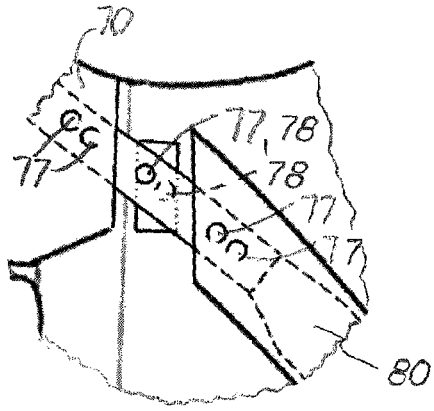
FIG. 11 is a partial plan view of the portion of the first support strap that extends from the upper anchor with intermediately located snaps that selectively attach to complimentary snap connectors mounted on the side of the body shell.

Like body support 10, on body support 10' the upper section of the first support straps 80, 80' extend through the upper anchors 70, 70'. In body support 10, the middle sections of the first straps 80, 80' are exposed and may be selectively attached to the outer surface of the upper torso section 30 via a plurality of snapping caps 85 attached to the inside surface of the first support strap 80 and a single snapping post 75 securely attached to the outer surface of the upper torso section 30 (see FIG. 6). As shown in FIG. 10, in the second embodiment body support 10', the first support straps 80, 80' slide freely through the upper anchors 70, 70', respectively, and may be selectively connected via snaps 77 and 78 (or hook and loop connectors or buttons, not shown) attached to the first support strap 80, 80' and the body shell 12, at locations below the armpit or axilla. During use, the user may adjust the tension on the upper and lower sections of the first support straps 80, 80' to provide greater or less support and comfort.

Figure 12:
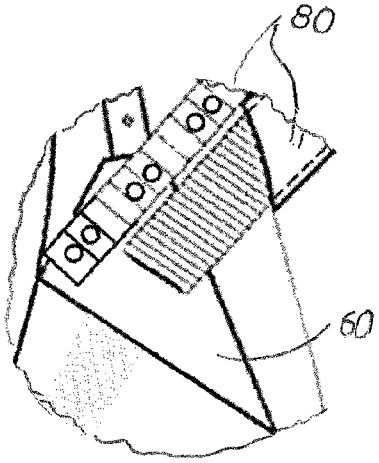
FIG. 12 is a partial plan view of the lower anchor showing the proximal end of one first support strap fixed thereto and the distal end of the second support strap being adjustably attached to the lower anchor.

FIG. 12 shows one end of the first support strap 80 being sewn or adhesively attached to a lower anchor 60 that the opposite end of the first support strap 80 being selectively attached to the anchor 60 via snaps 82, 84 attached to the first support strap 80 and the lower anchor 60.

Also, in the second embodiment, the reinforcement band 130 is used in place of abdominal strap 22.

Figure 13:
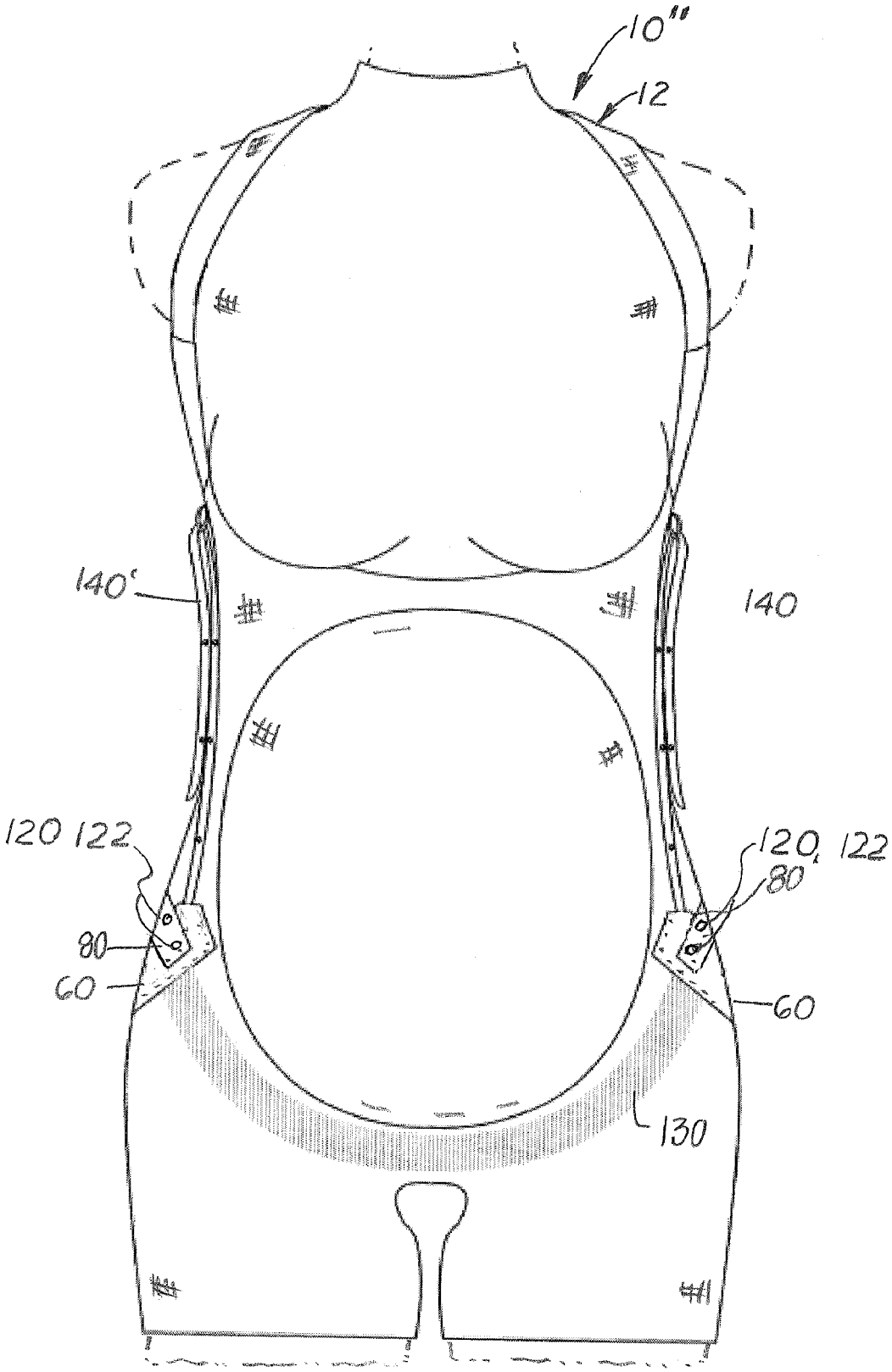
FIG. 13 is a front elevational view of a woman wearing the third embodiment of the maternity body support.
Figure 14:
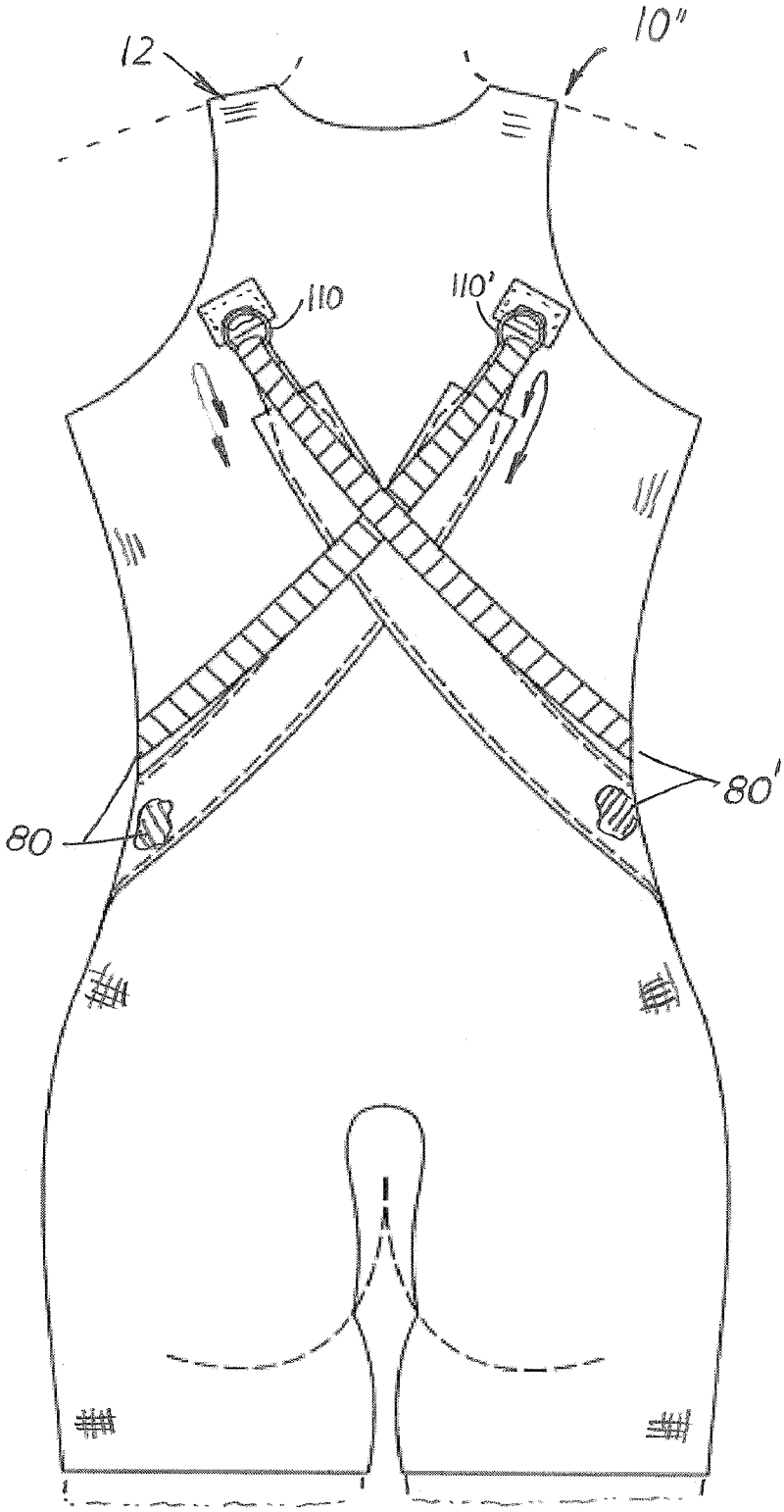
FIG. 14 is a rear elevational view of the woman wearing the maternity body support body shown in FIG. 13.
Figure 15:
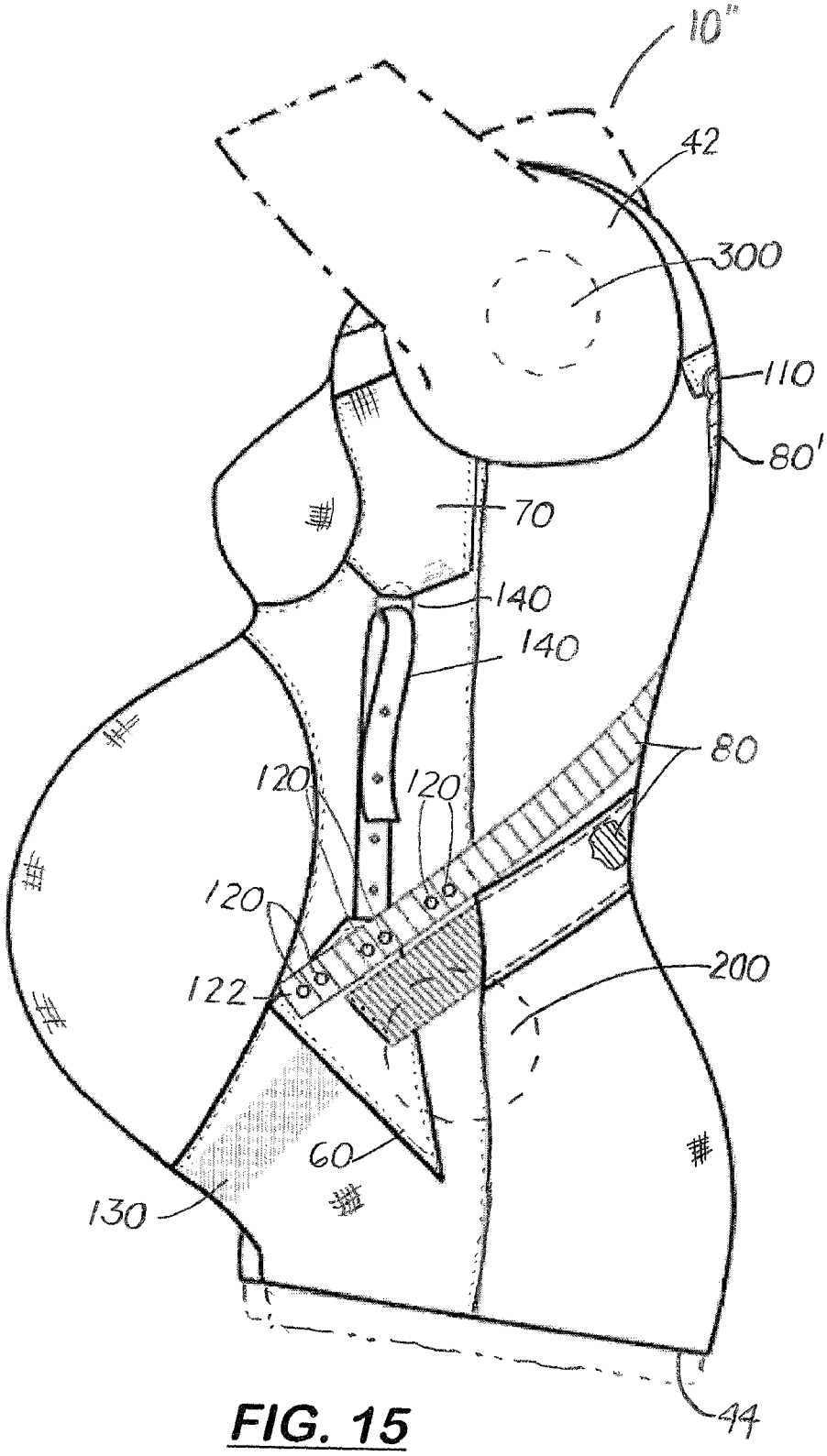
FIG. 15 is a side elevational view of the woman wearing the maternity body support shown in FIGS. 13 and 14.

FIGS. 13-14 show a third embodiment of the body support 10", that is identical to the second embodiment of the body support 10' except that the means for linking the first support straps 80, 80' to the opposite shoulder complex 300 is accomplished by affixing a ring 110, 110' over the back of the shoulder complex 300 and then looping the first strap support 80, 80', respectively, therethrough. The distal end of the first support straps 80, 80' then extend downward and wrap around the side of the user and connect to snaps located on the lower anchors 60, 60', respectively. Attached to the distal end of each first support straps 80, 80' are several longitudinally aligned snap connectors 120. The snap connector 120 connects to snap posts 122 located on the lower anchor 60, that enables the user to shorten or length the overall length of the first strap to provide greater comfort and support. A reinforcement band 130 is used on body support 10" in place of the abdominal strap 22.

The body support 10, 10', and 10" are lightweight, stretchable body-conforming material commonly know as 'shape wear'. 'Shape wear' is defined as a flexible, stretchable undergarment made of cotton, nylon and polyesters or combinations thereof, used to provide support and comfort. The lower and upper anchors 60, 60' and 70, 70', respectively, are made of reinforced nylon or cotton, and the first and second support straps 80, 80' and 120, 120' are made of nylon or cotton.

During use, the body shell 12 is worn so that the user's arms and legs fit through the arm opening 42, 42' and leg openings 44, 44', respectively, and her abdomen fits through the abdomen opening 50. The tension of the first straps 80, 80' and second support straps 120, 120' are adjusted so that when used in combination, they simultaneously rotate the opposite sides of pelvis backwards and move the opposite shoulder complex 300 towards the midline, or neutral alignment in the sagittal plane. This combined movement forces the body towards the vertical alignment in the sagittal plane, thereby reducing the curves of the spine and the pelvis.

It should be understood that the methods described herein to connect the first support straps 80, 80' and second support straps 120, 120' to the upper anchor 70, 70' and lower anchors 60, 60', respectively, and to adjust their overall lengths is but one method and that a variety of different methods and structures may be used. The key aspects are that the opposite pelvic joint 200 and shoulder complex 300 must be adjustably linked together by two first support straps 80, 80' that extends over the user's back and pulls the two shoulder complexes 300 rearward and downward and the second support straps 120, 120' that links the two pelvic joints 200 and the shoulder complex 300 on the same side of the body.

In compliance with the statute, the invention described herein has been described in language more or less specific as to structural features. It should be understood however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

We claim:

1. A maternity body support, comprising:

a. a body shell with a lower torso section that fits around a user's lower abdomen, buttocks and both hips, an upper torso section that transversely fits over a user's anterior surface under the user's two breasts and laterally along opposite sides of a user's torso, an abdominal opening located between said lower torso section and said upper torso section in which a user's abdomen may extend, and a back torso section that covers the back of a user's torso;

b. two lower anchors attached to the opposite sides of said lower torso section adjacent to the user's pelvis joint when said body shell is worn;

c. two upper anchors attached to the opposite sides of said upper torso section at a position forward to and under the user's axillas;

d. a pair of length adjustable first support straps, each said first support strap attached at one end to said lower anchor located on opposite sides of said body shell, each said first support strap extends upward from the lower anchor behind the user's lower back and is coupled to the user's opposite shoulder complex; and, e. a pair of length adjustable second support straps each attached at one end to said lower anchor and attached at an opposite end to said upper anchor located there above.

2. The maternity body support, as recited in claim 1, wherein said pair of first support straps are made of elastic material.

3. The maternity body support, as recited in claim 1, wherein said pair of second support straps are made of elastic material.

4. The maternity body support, as recited in claim 2, wherein said pair of second support straps are made of elastic material.

5. The maternity body support, as recited in claim 1, further including two rings attached to said upper anchors and said pair of second support straps are attached to each one of said upper anchors by extending through each one of said ring.

6. The maternity body support, as recited in claim 2, further including two rings attached to said upper anchors and said pair of second support straps are attached to each one of said upper anchors by extending through each one of said ring.

7. The maternity body support, as recited in claim 1, wherein each said first support strap is attached to said lower anchor, extends across the back and over the top of the user's shoulders and across the upper anchor located on the side of the body opposite said lower anchor and then extends downward and across the lower back and connects to said lower anchor to which the opposite end of said first support strap is attached.

8. The maternity body support, as recited in claim 2, wherein each said first support strap is attached to said lower anchor, extends across the back and over the top of the user's shoulders and across the upper anchor located on the side of the body opposite said lower anchor and then extends downward and across the lower back and connects to said lower anchor to which the opposite end of said first support strap is attached.

9. The maternity body support, as recited in claim 1, wherein each said first support strap includes at least one end with means for selectively connecting said first strap to said lower anchor.

10. The maternity body support, as recited in claim 9, further including two rings with one said a ring attached to one said upper anchor wherein one said second support strap is attached to said upper anchor by extending through said ring.

11. The maternity body support, as recited in claim 1, wherein each said first support strap includes an intermediate section and a means for selectively attaching the intermediate section of each said first support strap to the side of said body shell.

12. The maternity body support, as recited in claim 11, wherein said pair of first support straps are made of elastic material.

13. The maternity body support, as recited in claim 7, wherein each said first support strap includes an intermediate section and means for selectively adjusting the tension of said intermediate section of said first support strap are a plurality of connectors located on said first support strap and said body shell.

14. The maternity body support, as recited in claim 1, further including two tunnels formed on said body shell through which one said first support strap extends to properly aligned each said first support strap on said body shell.

15. The maternity body support, as recited in claim 1, further including said body shell having two shoulder straps.

16. The maternity body support, as recited in claim 1, further including an abdominal cover affixed to said body shell and extending over said abdominal opening.

17. The maternity body support, as recited in claim 1, further including a ring affixed to said body shell on the back of the user near the shoulder complex to which said first support strap may be attached.

18. The maternity body support, as recited in claim 1, further including a reinforcement band located on said lower torso section and under said abdominal opening.

19. The maternity body support, as recited in claim 1, wherein said body shell is made of stretchable shape wear material.

20. A maternity body support, comprising:

a. a body shell with a lower torso section that fits around a user's lower abdomen, buttocks and both hips, an upper torso section that transversely fits over a user's anterior surface and laterally along opposite sides of a user's torso, an abdominal opening located between said lower torso section and said upper torso section in which a user's abdomen may extend, and a back torso section that covers the back of a user's torso;

b. two lower anchors each affixed to the opposite sides of said lower torso section adjacent to the user's pelvis joints when said body shell is worn;

c. two upper anchors each affixed to the opposite sides of said upper torso section at a position above said lower anchor and under the user's axilla;

d. a pair of length adjustable first support straps each attached at one end to said lower anchor located on opposite sides of said body shell, each said first support strap extends upward from the lower anchor behind the user's lower back and is coupled to said upper anchor located on the user's opposite side; and, e. a pair of length adjustable second support straps each attached at one end to said lower anchor and attached at an opposite end to said upper anchor located there above.

* * * * *